US010946663B2

(12) United States Patent
Kohnotoh

(10) Patent No.: US 10,946,663 B2
(45) Date of Patent: Mar. 16, 2021

(54) INKJET PRINTING APPARATUS

(71) Applicant: CANON KABUSHIKI KAISHA, Tokyo (JP)

(72) Inventor: Atsushi Kohnotoh, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/364,386

(22) Filed: Mar. 26, 2019

(65) Prior Publication Data

US 2019/0299639 A1 Oct. 3, 2019

(30) Foreign Application Priority Data

Mar. 30, 2018 (JP) ..... JP2018-068362

(51) Int. Cl.

| | |
|---|---|
| ***B41J 2/175*** | (2006.01) |
| ***B41J 23/00*** | (2006.01) |
| ***B41J 2/045*** | (2006.01) |
| ***B41J 2/155*** | (2006.01) |

(52) U.S. Cl.

CPC ..... *B41J 2/17556* (2013.01); *B41J 2/04501* (2013.01); *B41J 2/155* (2013.01); *B41J 2/1752* (2013.01); *B41J 2/17513* (2013.01); *B41J 23/00* (2013.01); *B41J 2202/14* (2013.01)

(58) Field of Classification Search

CPC ..... B41J 2202/14

See application file for complete search history.

(56) References Cited

U.S. PATENT DOCUMENTS

| | | | | |
|---|---|---|---|---|
| 6,234,605 | B1 * | 5/2001 | Hilton | B41J 2/15 347/13 |
| 8,348,401 | B2 | 1/2013 | Sekino et al. | |
| 8,430,487 | B2 * | 4/2013 | Sekino | B41J 2/175 347/86 |
| 8,602,538 | B2 | 12/2013 | Sekino et al. | |
| 8,794,748 | B2 * | 8/2014 | Borra | B41J 2/17556 347/85 |
| 10,035,354 | B1 * | 7/2018 | Piatt | B41J 2/17526 |
| 2007/0091152 | A1 * | 4/2007 | Rademakers | B41J 2/17523 347/85 |
| 2009/0141084 | A1 * | 6/2009 | Kim | B41J 2/155 347/50 |

FOREIGN PATENT DOCUMENTS

| | | | |
|---|---|---|---|
| JP | 2003200595 A | * | 7/2003 |
| JP | 2012-045890 A | | 3/2012 |

OTHER PUBLICATIONS

Machine generated, English translation of JP2003200595A to Sayama, "Ink Jet Recorder"; translation retrieved from https://www.epo.org/index.html on Mar. 16, 2020; 12pp.*

U.S. Appl. No. 16/366,693, Atsushi Kahnotoh, filed Mar. 27, 2019.

* cited by examiner

*Primary Examiner* — Shelby L Fidler

(74) *Attorney, Agent, or Firm* — Venable LLP

(57) ABSTRACT

An inkjet printing apparatus is provided capable of attaching and detaching of a print head with a mechanism that is easily operable and simple, while preventing an erroneous operation. For the purpose, it is configured so that the press/release for the print head is possible along with movement of the joint member. Further, when the joint member is connected, the connection of the joint member is performed after pressing the print head, and when the connection of the joint member is released, the pressure on the print head is released after releasing the connection of the joint member.

17 Claims, 14 Drawing Sheets

INKJET PRINTING APPARATUS

BACKGROUND OF THE INVENTION

Field of the Invention

The present invention relates to an inkjet printing apparatus for printing by ejecting ink from a print head, and in particular relates to an inkjet printing apparatus including a detachable print head.

Description of the Related Art

In Japanese Patent Laid-Open No. 2012-45890, there is described that, in a case where two steps of lever operation are necessary when attaching and detaching of a print head are performed, a motion of a lever to be operated secondarily is regulated by a lever to be operated primarily so that these two levers can be operated in the correct order.

By adopting the configuration as in Japanese Patent Laid-Open No. 2012-45890, an erroneous operation of making an error in the lever operation in attaching and detaching of a print head can be prevented. However, there is no reference to an erroneous operation of performing attaching and detaching of a print head without performing lever operation. Moreover, there are such problems that the operation is complicated because an operator is caused to perform plural steps of operation, and that a mechanism is complex.

SUMMARY OF THE INVENTION

Accordingly, the present invention provides an inkjet printing apparatus capable of performing attaching and detaching of a print head with easy operation and simple mechanism, while preventing erroneous operations.

Therefore, an inkjet printing apparatus of the present invention comprising: a print head configured to eject ink; a support unit configured to detachably support the print head; a joint unit connectable with the print head configured to perform transfer of the ink relative to the print head; a pressure unit configured to press the print head relative to the support unit; and a pressure release unit configured to release pressure of the pressure unit along with movement of the joint unit, wherein the joint unit is movable to a first position connected with the print head pressed by the pressure unit, a second position at which connection with the print head pressed by the pressure unit has been released, and a third position at which pressure has been released by the pressure release unit and connection with the print head has been released.

According to the present invention, it is possible to realize an inkjet printing apparatus capable of attaching and detaching of a print head with a mechanism that is easily operable and simple, while preventing erroneous operation.

Further features of the present invention will become apparent from the following description of exemplary embodiments with reference to the attached drawings.

DESCRIPTION OF THE EMBODIMENTS

Hereinafter, embodiments of the present invention will be explained with reference to the drawings.

Figure 1:
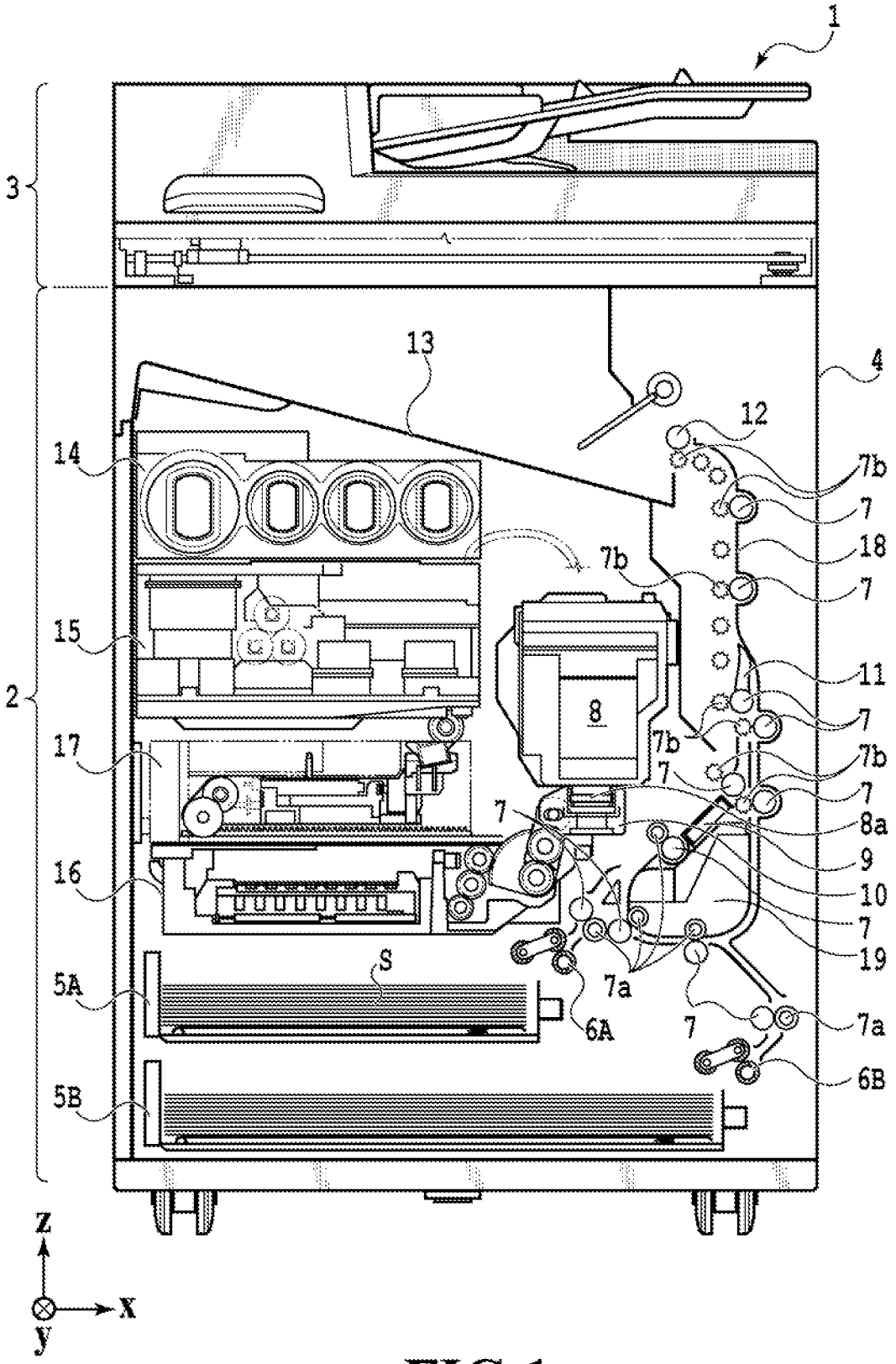
FIG. 1 illustrates a view showing an internal configuration of an inkjet printing apparatus.

FIG. 1 is an internal configuration diagram of an inkjet printing apparatus 1 (hereinafter "printing apparatus 1") used in the present embodiment. In the drawings, an x-direction is a horizontal direction, a y-direction (a direction perpendicular to paper) is a direction in which ejection openings are arrayed in a print head 8 described later, and a z-direction is a vertical direction.

The printing apparatus 1 is a multifunction printer comprising a print unit 2 and a scanner unit 3. The printing apparatus 1 can use the print unit 2 and the scanner unit 3 separately or in synchronization to perform various processes related to print operation and scan operation. The scanner unit 3 comprises an automatic document feeder (ADF) and a flatbed scanner (FBS) and is capable of scanning a document automatically fed by the ADF as well as scanning a document placed by a user on a document plate of the FBS. The present embodiment is directed to the multifunction printer comprising both the print unit 2 and the scanner unit 3, but the scanner unit 3 may be omitted. FIG. 1 shows the printing apparatus 1 in a standby state in which neither print operation nor scan operation is performed.

In the print unit 2, a first cassette 5A and a second cassette 5B for housing printing medium (cut sheets) S are detachably provided at the bottom of a casing 4 in the vertical direction. Relatively small printing medium of up to A4 size are stacked and housed in the first cassette 5A and relatively large printing medium of up to A3 size are stacked and housed in the second cassette 5B. A first feeding unit 6A for feeding housed printing medium one by one is provided near the first cassette 5A. Similarly, a second feeding unit 6B is provided near the second cassette 5B. In print operation, a print medium S is selectively fed from either one of the cassettes.

Conveying rollers 7, a discharging roller 12, pinch rollers 7*a*, spurs 7*b*, a guide 18, an inner guide 19, and a flapper 11 are conveying mechanisms for guiding a print medium S in a predetermined direction. The conveying rollers 7 are drive rollers located upstream and downstream of the print head 8 (platen 9) and driven by a conveying motor (not shown). The pinch rollers 7*a* are follower rollers that are turned while nipping a print medium S together with the conveying rollers 7. The discharging roller 12 is a drive roller located downstream of the conveying rollers 7 and driven by the conveying motor (not shown). The spurs 7*b* nip and convey a print medium S together with the conveying rollers 7 and discharging roller 12 located downstream of the print head 8 (platen 9).

The printing apparatus 1 has multiple motors for driving the above drive rollers, and each drive roller is connected to one of the motors. The relationship between the motors and the drive roller will be described later in detail.

The guide 18 is provided in a conveying path of a print medium S to guide the print medium S in a predetermined direction. The inner guide 19 is a member extending in the y-direction. The inner guide 19 has a curved side surface and guides a print medium S along the side surface. The flapper 11 is a member for changing a direction in which a print medium S is conveyed in duplex print operation. A discharging tray 13 is a tray for stacking and housing printing medium S that were subjected to print operation and discharged by the discharging roller 12.

The print head 8 of the present embodiment is a full line type color inkjet print head. In the print head 8, a plurality of ejection openings configured to eject ink based on print data are arrayed in the y-direction in FIG. 1 so as to correspond to the width of a print medium S. That is, the print head is configured to eject inks of a plurality of colors. When the print head 8 is in a standby position, an ejection opening surface 8*a* of the print head 8 is oriented vertically downward and capped with a cap unit 10 as shown in FIG. 1. In print operation, the orientation of the print head 8 is changed by a print controller 202 described later such that the ejection opening surface 8*a* faces a platen 9. The platen 9 includes a flat plate extending in the y-direction and supports a print medium S being subjected to print operation by the print head 8 from the back side. The movement of the print head 8 from the standby position to a printing position will be described later in detail.

An ink tank unit 14 separately stores ink of four colors to be supplied to the print head 8. An ink supply unit 15 is provided in the midstream of a flow path connecting the ink tank unit 14 to the print head 8 to adjust the pressure and flow rate of ink in the print head 8 within a suitable range. The present embodiment adopts a circulation type ink supply system, where the ink supply unit 15 adjusts the pressure of ink supplied to the print head 8 and the flow rate of ink collected from the print head 8 within a suitable range.

A maintenance unit 16 comprises the cap unit 10 and a wiping unit 17 and activates them at predetermined timings to perform maintenance operation for the print head 8. The maintenance operation will be described later in detail.

Figure 2:
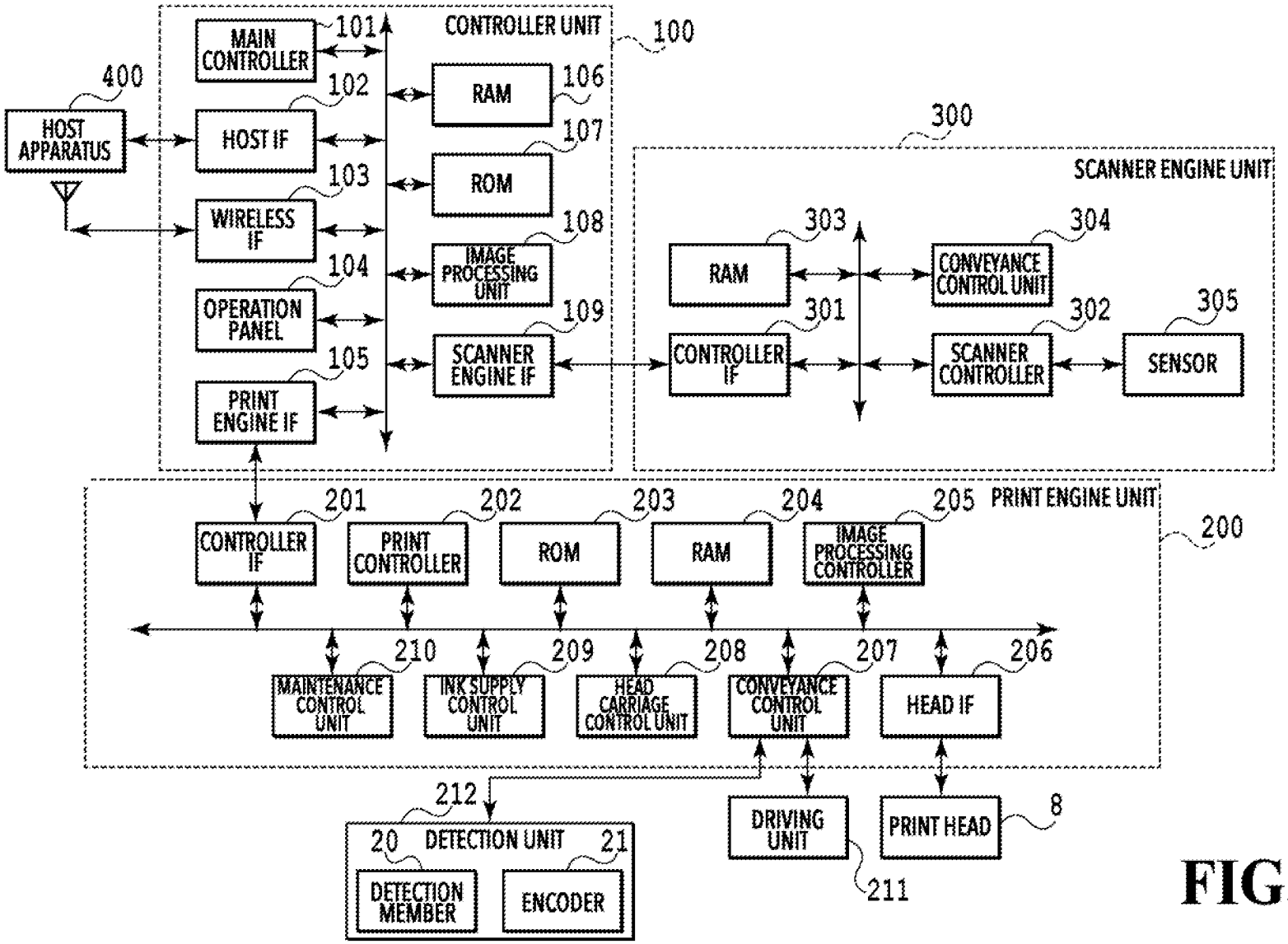
FIG. 2 illustrates a block diagram showing a control configuration in the printing apparatus.

FIG. 2 is a block diagram showing a control configuration in the printing apparatus 1. The control configuration mainly includes a print engine unit 200 that exercises control over the print unit 2, a scanner engine unit 300 that exercises control over the scanner unit 3, and a controller unit 100 that exercises control over the entire printing apparatus 1. A print controller 202 controls various mechanisms of the print engine unit 200 under instructions from a main controller 101 of the controller unit 100. Various mechanisms of the scanner engine unit 300 are controlled by the main controller 101 of the controller unit 100. The control configuration will be described below in detail.

In the controller unit 100, the main controller 101 including a CPU controls the entire printing apparatus 1 using a RAM 106 as a work area in accordance with various parameters and programs stored in a ROM 107. For example, when a print job is input from a host apparatus 400 via a host I/F 102 or a wireless I/F 103, an image processing unit 108 executes predetermined image processing for received image data under instructions from the main controller 101. The main controller 101 transmits the image data subjected to the image processing to the print engine unit 200 via a print engine I/F 105.

The printing apparatus 1 may acquire image data from the host apparatus 400 via a wireless or wired communication or acquire image data from an external storage unit (such as a USB memory) connected to the printing apparatus 1. A communication system used for the wireless or wired communication is not limited. For example, as a communication system for the wireless communication, Wi-Fi (Wireless Fidelity; registered trademark) and Bluetooth (registered trademark) can be used. As a communication system for the wired communication, a USB (Universal Serial Bus) and the like can be used. For example, when a scan command is input from the host apparatus 400, the main controller 101 transmits the command to the scanner unit 3 via a scanner engine I/F 109.

An operating panel 104 is a mechanism to allow a user to do input and output for the printing apparatus 1. A user can give an instruction to perform operation such as copying and scanning, set a print mode, and recognize information about the printing apparatus 1 via the operating panel 104.

In the print engine unit 200, the print controller 202 including a CPU controls various mechanisms of the print unit 2 using a RAM 204 as a work area in accordance with various parameters and programs stored in a ROM 203. When various commands and image data are received via a controller I/F 201, the print controller 202 temporarily stores them in the RAM 204.

The print controller 202 allows an image processing controller 205 to convert the stored image data into print data such that the print head 8 can use it for print operation. After the generation of the print data, the print controller 202 allows the print head 8 to perform print operation based on the print data via a head I/F 206. At this time, the print controller 202 conveys a print medium S by driving the feeding units 6A and 6B, conveying rollers 7, discharging roller 12, and flapper 11 shown in FIG. 1 via a conveyance control unit 207. The print head 8 performs print operation in synchronization with the conveyance operation of the print medium S under instructions from the print controller 202, thereby performing printing.

The conveyance control unit 207, connected to the detection unit 212 for detecting the conveyance state of the printing medium S and the drive unit 211 for driving the drive rollers, controls the conveyance of the printing medium S using the drive unit 211, based on detection results obtained from the detection unit 212. The detection unit 212 has the detection members 20 for detecting the printing medium S and the encoders 21 for detecting the amount of rotation of the drive rollers.

Printing is performed in the course of the conveyance of the printing medium S by the conveyance control unit 207, by the print head 8 performing print operation under instructions from the print controller 202.

A head carriage control unit 208 changes the orientation and position of the print head 8 in accordance with an operating state of the printing apparatus 1 such as a maintenance state or a printing state. An ink supply control unit 209 controls the ink supply unit 15 such that the pressure of ink supplied to the print head 8 is within a suitable range. A maintenance control unit 210 controls the operation of the cap unit 10 and wiping unit 17 in the maintenance unit 16 when performing maintenance operation for the print head 8.

In the scanner engine unit 300, the main controller 101 controls hardware resources of the scanner controller 302 using the RAM 106 as a work area in accordance with various parameters and programs stored in the ROM 107, thereby controlling various mechanisms of the scanner unit 3.

For example, the main controller 101 controls hardware resources in the scanner controller 302 via a controller I/F 301 to cause a conveyance control unit 304 to convey a document placed by a user on the ADF and cause a sensor 305 to scan the document. The scanner controller 302 stores scanned image data in a RAM 303. The print controller 202 can convert the image data acquired as described above into print data to enable the print head 8 to perform print operation based on the image data scanned by the scanner controller 302.

Figure 3:
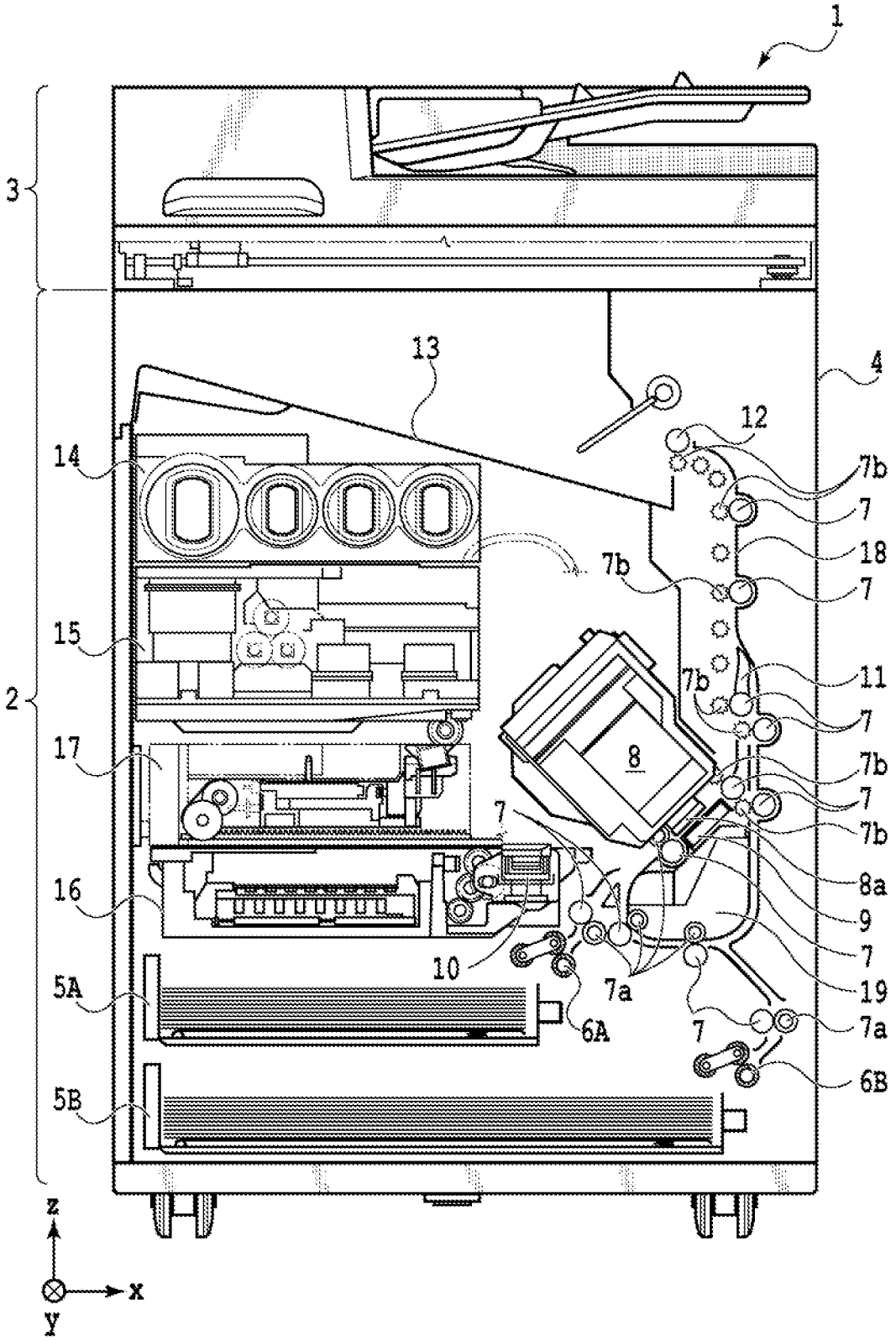
FIG. 3 illustrates a view showing the printing apparatus in a printing state.

FIG. 3 shows the printing apparatus 1 in a printing state. As compared with the standby state shown in FIG. 1, the cap unit 10 is separated from the ejection opening surface 8*a* of the print head 8 and the ejection opening surface 8*a* faces the platen 9. In the present embodiment, the plane of the platen 9 is inclined about 45° with respect to the horizontal plane. The ejection opening surface 8*a* of the print head 8 in a printing position is also inclined about 45° with respect to the horizontal plane so as to keep a constant distance from the platen 9.

In moving the print head 8 from the standby position shown in FIG. 1 to the printing position shown in FIG. 3, the print controller 202 uses the maintenance control unit 210 to move the cap unit 10 down to an evacuation position shown in FIG. 3, thereby separating the cap member from the ejection opening surface 8*a* of the print head 8. The print controller 202 then uses the head carriage control unit 208 to turn the print head 8 by 45° while adjusting the vertical height of the print head 8 such that the ejection opening surface 8*a* faces the platen 9. After the completion of print operation, the print controller 202 reverses the above procedure in moving the print head 8 from the printing position to the standby position.

Next, a conveying path of the print medium S in the print unit 2 will be described. Upon receipt of a print command, the print controller 202 first uses the maintenance control unit 210 and the head carriage control unit 208 to move the print head 8 to the printing position shown in FIG. 3. The print controller 202 then uses the conveyance control unit 207 to drive either the first feeding unit 6A or the second feeding unit 6B to feed the print medium S in accordance with the print command.

Figure 4C:
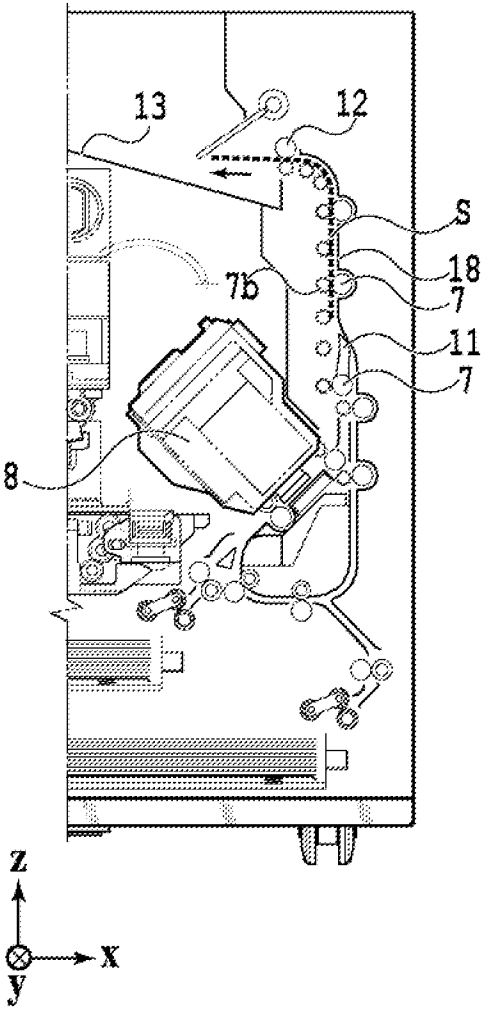
FIG. 4C illustrates a view showing a conveying path when the print medium is fed.
Figure 4B:
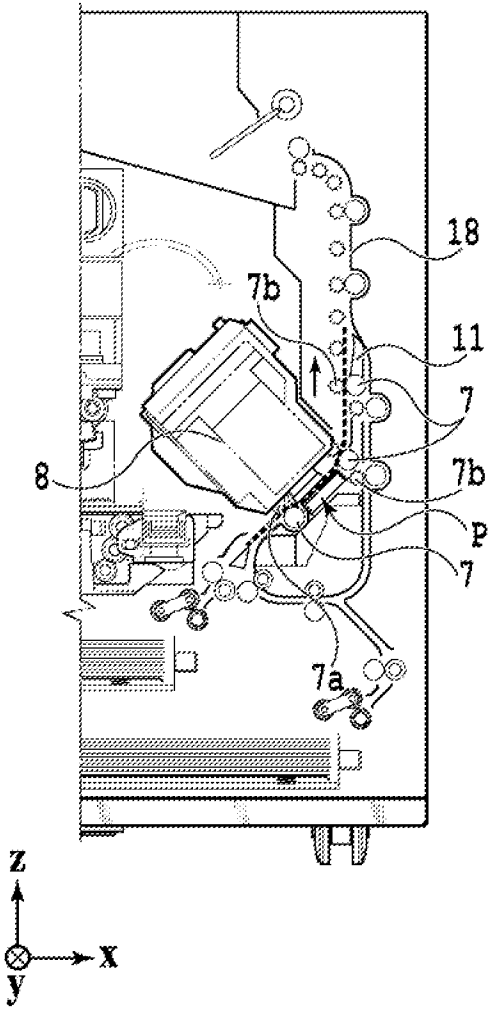
FIG. 4B illustrates a view showing a conveying path when the print medium is fed.
Figure 4A:
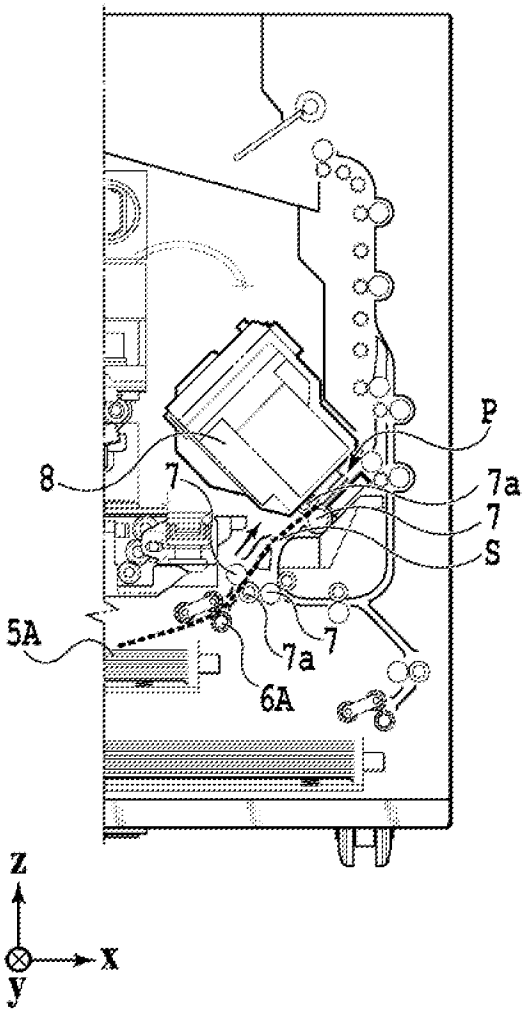
FIG. 4A illustrates a view showing a conveying path when a print medium is fed.

FIGS. 4A to 4C are diagrams showing a conveying path in the case of feeding an A4 size print medium S from the first cassette 5A. A print medium S at the top of a stack of printing medium in the first cassette 5A is separated from the rest of the stack by the first feeding unit 6A and conveyed toward a print area P between the platen 9 and the print head 8 while being nipped between the conveying rollers 7 and the pinch rollers 7*a*. FIG. 4A shows a conveying state where the front end of the print medium S is about to reach the print area P. The direction of movement of the print medium S is changed from the horizontal direction (x-direction) to a direction inclined about 45° with respect to the horizontal direction while being fed by the first feeding unit 6A to reach the print area P.

In the print area P, a plurality of ejection openings provided in the print head 8 eject ink toward the print medium S. In an area where ink is applied to the print medium S, the back side of the print medium S is supported by the platen 9 so as to keep a constant distance between the ejection opening surface 8*a* and the print medium S. After ink is applied to the print medium S, the conveying rollers 7 and the spurs 7*b* guide the print medium S such that the print medium S passes on the left of the flapper 11 with its tip inclined to the right and is conveyed along the guide 18 in the vertically upward direction of the printing apparatus 1. FIG. 4B shows a state where the front end of the print medium S has passed through the print area P and the print medium S is being conveyed vertically upward. The conveying rollers 7 and the spurs 7*b* change the direction of movement of the print medium S from the direction inclined about 45° with respect to the horizontal direction in the print area P to the vertically upward direction.

After being conveyed vertically upward, the print medium S is discharged into the discharging tray 13 by the discharging roller 12 and the spurs 7*b*. FIG. 4C shows a state where the front end of the print medium S has passed through the discharging roller 12 and the print medium S is being discharged into the discharging tray 13. The discharged print medium S is held in the discharging tray 13 with the side on which an image was printed by the print head 8 down.

Figure 5C:
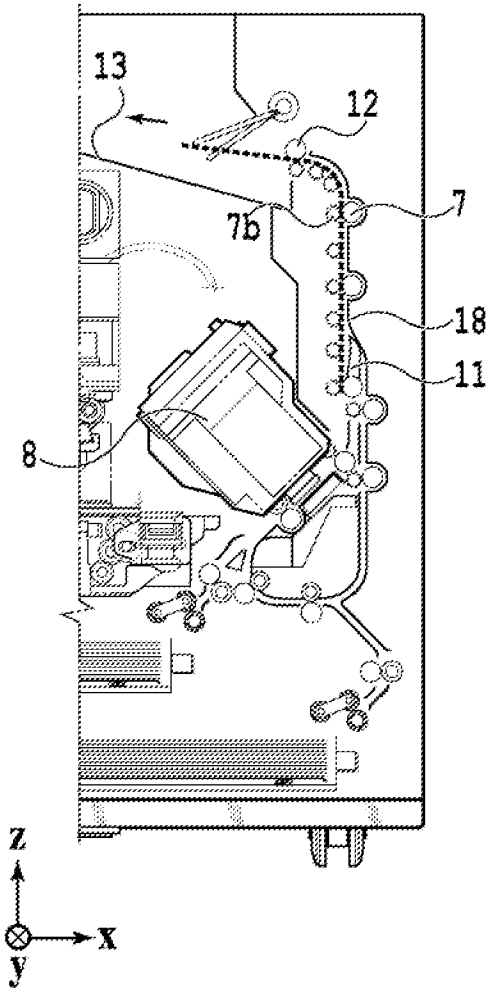
FIG. 5C illustrates a view showing a conveying path when the print medium is fed.
Figure 5B:
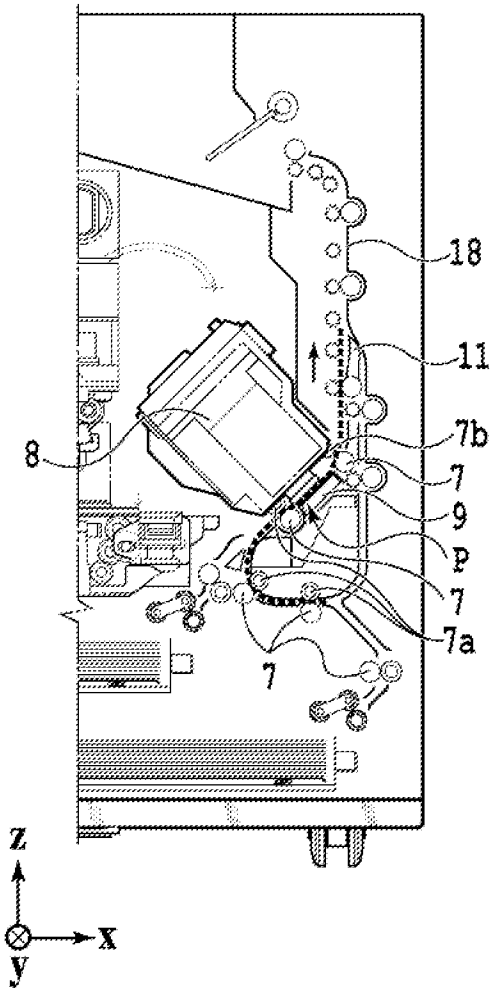
FIG. 5B illustrates a view showing a conveying path when the print medium is fed.
Figure 5A:
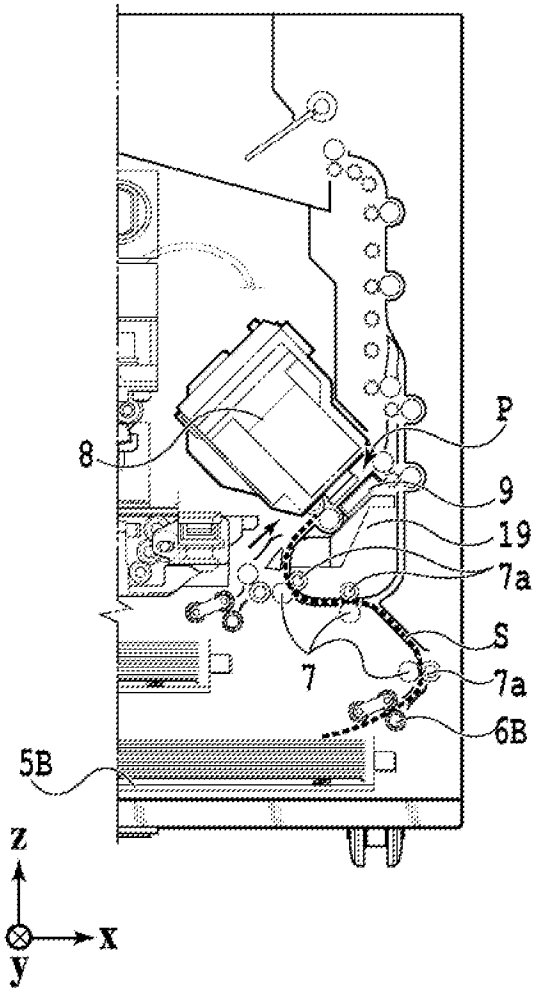
FIG. 5A illustrates a view showing a conveying path when the print medium is fed.

FIGS. 5A to 5C are diagrams showing a conveying path in the case of feeding an A3 size print medium S from the second cassette 5B. A print medium S at the top of a stack of printing medium in the second cassette 5B is separated from the rest of the stack by the second feeding unit 6B and conveyed toward the print area P between the platen 9 and the print head 8 while being nipped between the conveying rollers 7 and the pinch rollers 7*a*.

FIG. 5A shows a conveying state where the front end of the print medium S is about to reach the print area P. In a part of the conveying path, through which the print medium S is fed by the second feeding unit 6B toward the print area P, the plurality of conveying rollers 7, the plurality of pinch rollers 7*a*, and the inner guide 19 are provided such that the print medium S is conveyed to the platen 9 while being bent into an S-shape.

The rest of the conveying path is the same as that in the case of the A4 size print medium S shown in FIGS. 4B and 4C. FIG. 5B shows a state where the front end of the print medium S has passed through the print area P and the print medium S is being conveyed vertically upward. FIG. 5C shows a state where the front end of the print medium S has passed through the discharging roller 12 and the print medium S is being discharged into the discharging tray 13.

FIGS. 6A to 6D show a conveying path in the case of performing print operation (duplex printing) for the back side (second side) of an A4 size print medium S. In the case of duplex printing, print operation is first performed for the first side (front side) and then performed for the second side (back side). A conveying procedure during print operation for the first side is the same as that shown in FIGS. 4A to 4C and therefore description will be omitted. A conveying procedure subsequent to FIG. 4C will be described below.

Figures 6A, 6B, 6C, 6D:
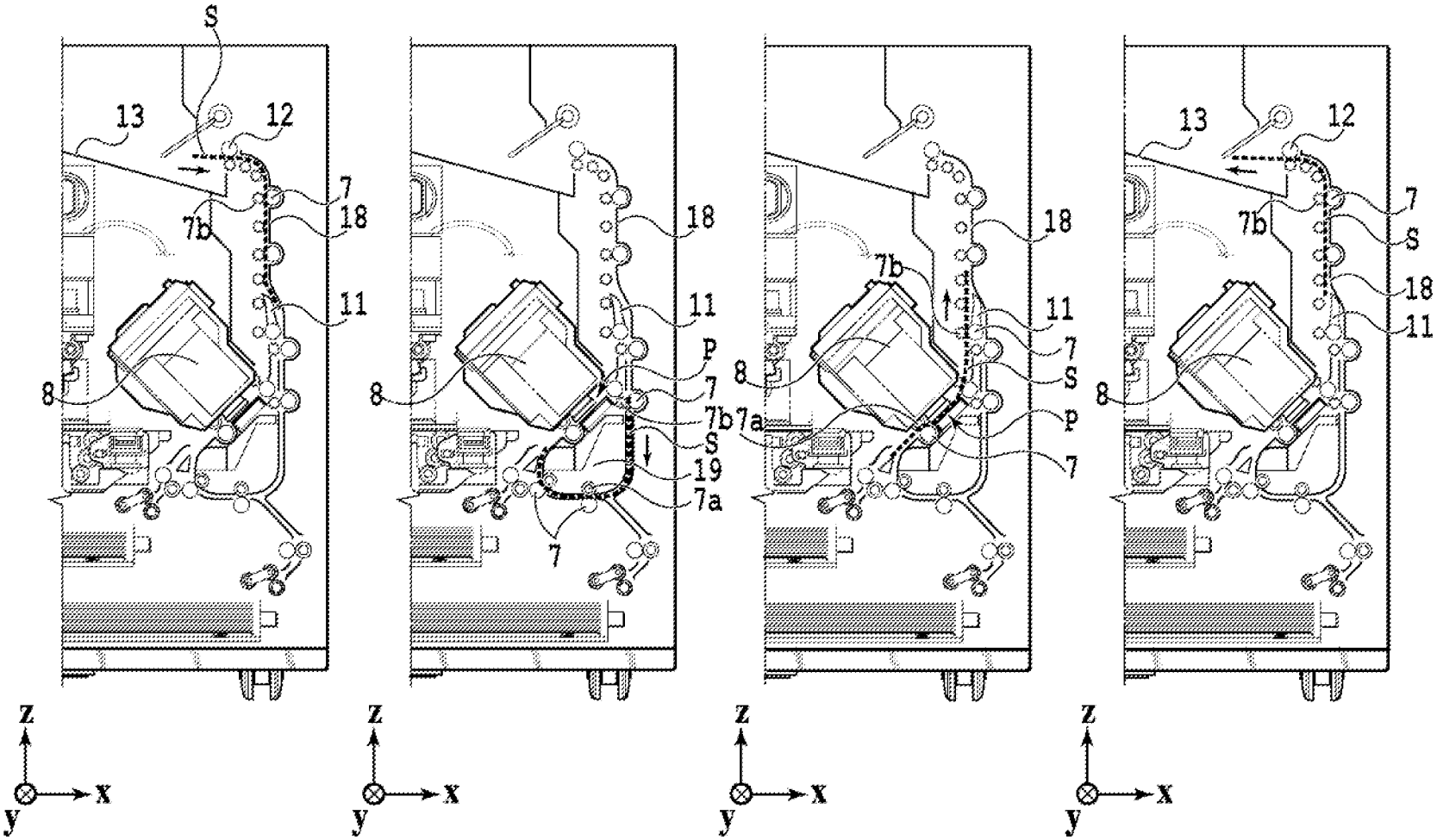
FIG. 6A illustrates a view showing a conveying path in a case where a print motion is performed.
FIG. 6B illustrates a view showing a conveying path in a case where a print motion is performed.
FIG. 6C illustrates a view showing a conveying path in a case where a print motion is performed.
FIG. 6D illustrates a view showing a conveying path in a case where a print motion is performed.

After the print head 8 finishes print operation for the first side and the back end of the print medium S passes by the flapper 11, the print controller 202 turns the conveying rollers 7 backward to convey the print medium S into the printing apparatus 1. At this time, since the flapper 11 is controlled by an actuator (not shown) such that the tip of the flapper 11 is inclined to the left, the front end of the print medium S (corresponding to the back end during the print operation for the first side) passes on the right of the flapper 11 and is conveyed vertically downward. FIG. 6A shows a state where the front end of the print medium S (corresponding to the back end during the print operation for the first side) is passing on the right of the flapper 11.

Then, the print medium S is conveyed along the curved outer surface of the inner guide 19 and then conveyed again to the print area P between the print head 8 and the platen 9. At this time, the second side of the print medium S faces the ejection opening surface 8*a* of the print head 8. FIG. 6B shows a conveying state where the front end of the print medium S is about to reach the print area P for print operation for the second side.

The rest of the conveying path is the same as that in the case of the print operation for the first side shown in FIGS. 4B and 4C. FIG. 6C shows a state where the front end of the print medium S has passed through the print area P and the print medium S is being conveyed vertically upward. At this time, the flapper 11 is controlled by the actuator (not shown) such that the tip of the flapper 11 is inclined to the right. FIG. 6D shows a state where the front end of the print medium S has passed through the discharging roller 12 and the print medium S is being discharged into the discharging tray 13.

Next, maintenance operation for the print head 8 will be described. As described with reference to FIG. 1, the maintenance unit 16 of the present embodiment comprises the cap unit 10 and the wiping unit 17 and activates them at predetermined timings to perform maintenance operation.

Figure 7:
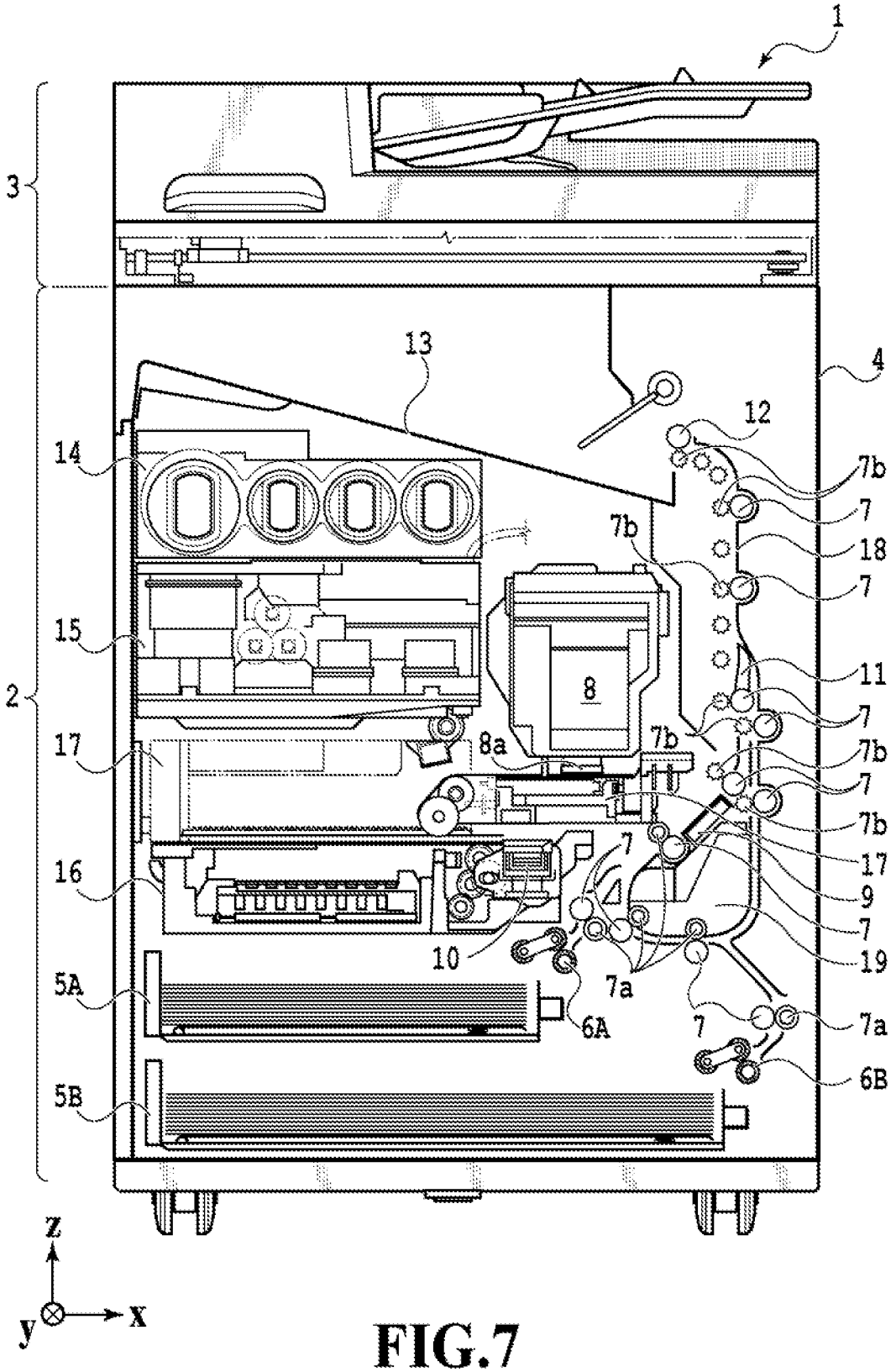
FIG. 7 illustrates a view showing the printing apparatus in a maintenance state.

FIG. 7 is a diagram showing the printing apparatus 1 in a maintenance state. In the case of moving the print head 8 from the standby position shown in FIG. 1 to a maintenance position shown in FIG. 7, the print controller 202 moves the print head 8 vertically upward and moves the cap unit 10 vertically downward. The print controller 202 then moves the wiping unit 17 from the evacuation position to the right in FIG. 7. After that, the print controller 202 moves the print head 8 vertically downward to the maintenance position where maintenance operation can be performed.

On the other hand, in the case of moving the print head 8 from the printing position shown in FIG. 3 to the maintenance position shown in FIG. 7, the print controller 202 moves the print head 8 vertically upward while turning it 45°. The print controller 202 then moves the wiping unit 17 from the evacuation position to the right. Following that, the print controller 202 moves the print head 8 vertically downward to the maintenance position where maintenance operation can be performed by maintenance unit 16.

Hereinafter, characteristic items of the present invention will be explained.

Figure 8:
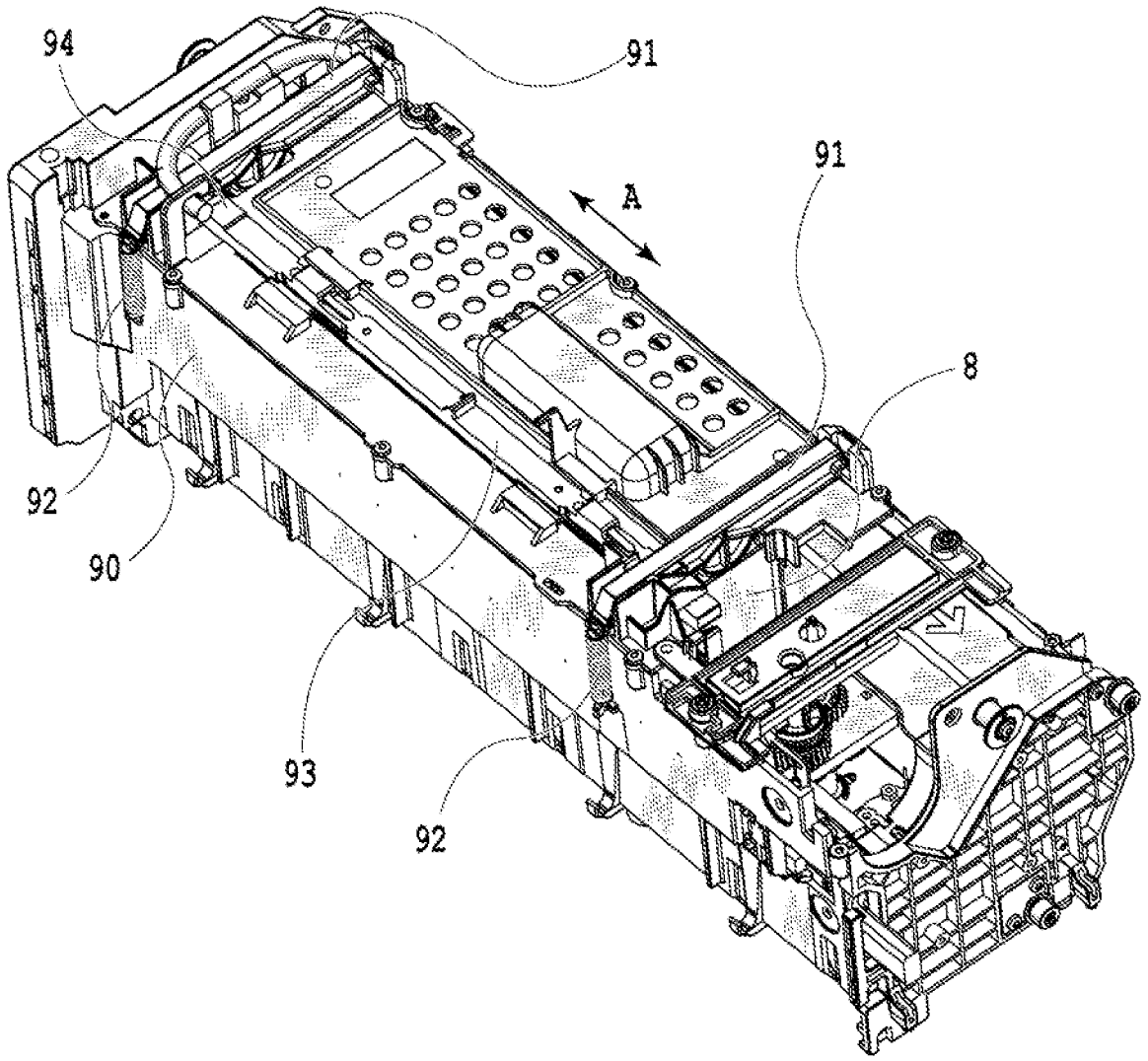
FIG. 8 illustrates a perspective view showing a print head inserted into a head holder.

FIG. 8 illustrates a perspective view showing the print head 8 inserted into a head holder 90. As shown in the drawing, the print head 8 is used in a state inserted into the head holder 90. The printing apparatus 1 includes a joint member 111 (refer to FIG. 9) that can be connected with the print head 8 inserted into the head holder 90. When the print head 8 is inserted into the head holder 90, to perform supply and recovery of ink for the print head 8, the print head 8 is connected with the joint member 111.

For the head holder 90, head press members 91 are equipped at two sites that are separately located in the longitudinal direction, and these two head press members 91 can press a surface opposite to a surface of the inserted print head 8 equipped with an ejection opening surface 8*a*. Meanwhile, the number of the head press members 91 is not limited to this, and may be a singular number or plural number. As a consequence of pressure on the print head 8 with the head press member 91, stable printing can be performed by position fixing of the print head 8 relative to the head holder 90 while the print head 8 inserted into the head holder 90 is configured so as not to be pulled out easily by a user.

The head press member 91 is supported turnably at one end part with the head holder 90, and the other end part is connected (engaged) with a head press spring 92. It is configured so as to press the print head 8 relative to the head holder 90 as a consequence of force applied by tension of the head press spring 92 in a turning direction of the head press member 91.

For the head holder 90, a spacer member (pressure release device) 93 is equipped, and the spacer member 93 is configured so as to be capable of receiving press force applied to the print head 8 by two head press members 91. Moreover, the spacer member 93 is equipped with two projecting cam units 94 provided corresponding to two head press members 91, and is configured so as to be slidable (movable) backward and forward in the insertion direction (arrow A direction) of the print head 8. As a consequence of sliding of the spacer member 93 in the arrow A direction and running of the head press member 91 on the cam unit 94 provided for the spacer member 93, the head press member 91 turns to release the pressure on the print head 8.

Inversely, it is configured so that the head press member 91 is separated from the unit part 94 and spaced apart from the spacer member 93 and thereby tension of the head press spring 92 applies press force to the print head 8. Meanwhile, the cam unit 94 is arranged so that the slide of the spacer member 93 leads to a positional relationship that results in an approximately simultaneous press or release of the print head 8 by two head press members 91.

Meanwhile, in this embodiment, although a configuration in which the head press member 91 and the head press spring 92 press the print head 8 is explained, configurations are not limited to this and the print head 8 may be pressed using a leaf spring in place of the head press member 91.

Figure 9:
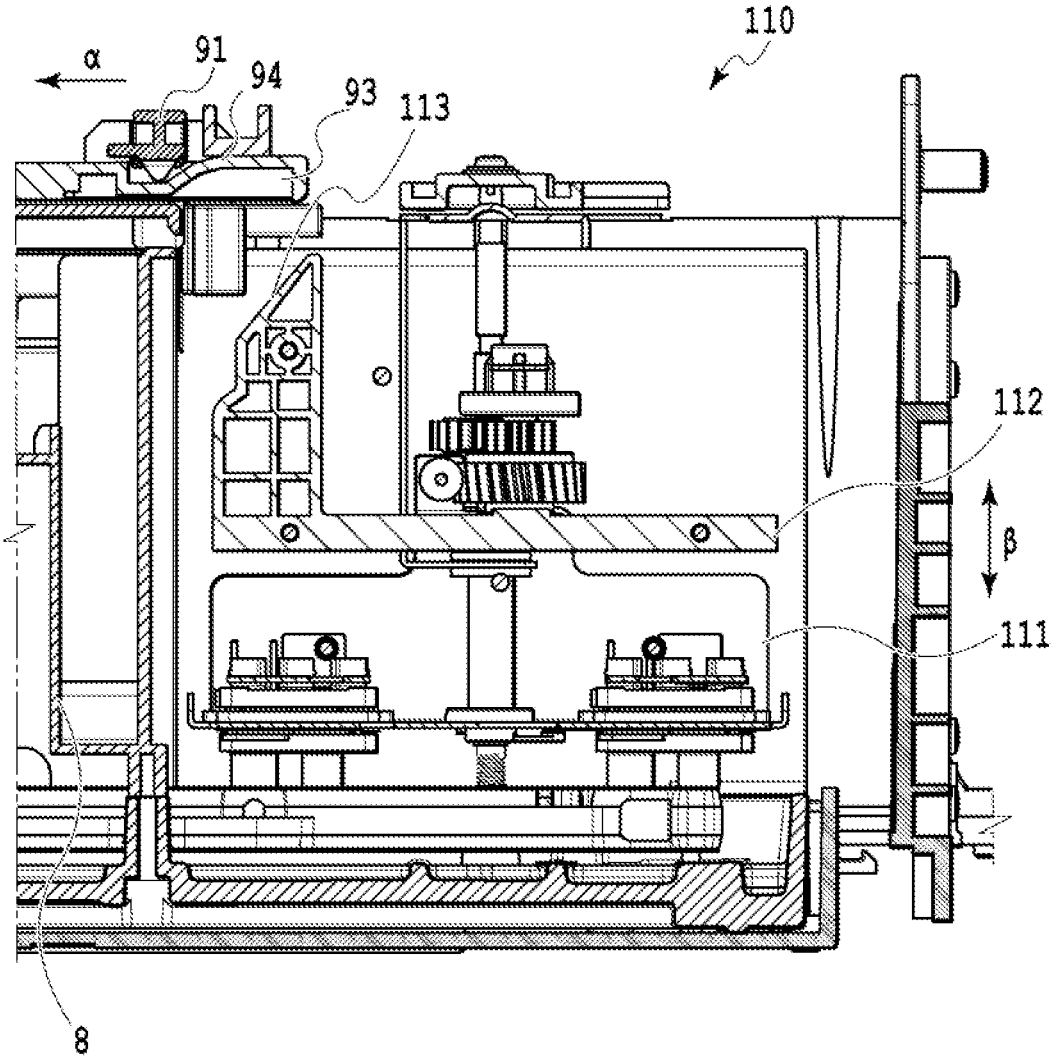
FIG. 9 illustrates a view showing a joint unit with which the print head and the joint member are connected.

FIG. 9 illustrates a view showing a joint unit 110 through which the print head 8 and the joint member 111 are connected. The joint member 111 is configured movably by being driven by a driving source not illustrated, and connection or release between the print head 8 and the joint member 111 is performed as a consequence of movement of the joint member 111 in an arrow β direction. FIG. 9 shows a state where the joint member 111 and the print head 8 are in connection. In the connected state of the joint member 111 and the print head 8, supply of ink to the print head 8 and recovery of ink from the print head 8 can be performed via the joint member 111. As a consequence of movement of the joint member 111 from the connected state in this way to the upper side in the drawing, the connection between the joint member 111 and the print head 8 is released.

The joint member 111 is equipped with an operation member 112, and the operation member 112 moves in the arrow β direction along with the movement of the joint member 111 in the arrow β direction. Moreover, the operation member 112 is equipped with an inclined unit 113 having an inclined surface, and the inclined unit 113 and the spacer member 93 are configured to be abuttable in accordance with a movement quantity of the joint member 111. The inclined unit 113 of the operation member 112 can perform switching of press and release relative to the print head 8 by changing the abutting position with the spacer member 93 in accordance with the movement quantity of the joint member 111 to thereby slide the spacer member 93.

In FIG. 9, the joint member 111 and the print head 8 are in a connected state and the operation member 112 lies at a sufficiently low position, and therefore the spacer member 93 and the operation member 112 (the inclined unit 113) are not abutted. In this state, since the spacer member 93 does not receive force from the inclined unit 113 and has not slid in an arrow α direction, the head press member 91 and the spacer member 93 are spaced apart, and therefore the print head 8 is pressed with the head press member 91. In other words, in this state the print head 8 is in a state where pullout from the printing apparatus 1 cannot be performed. This state is, usually, a state where the printing apparatus 1 may perform printing.

Figure 10:
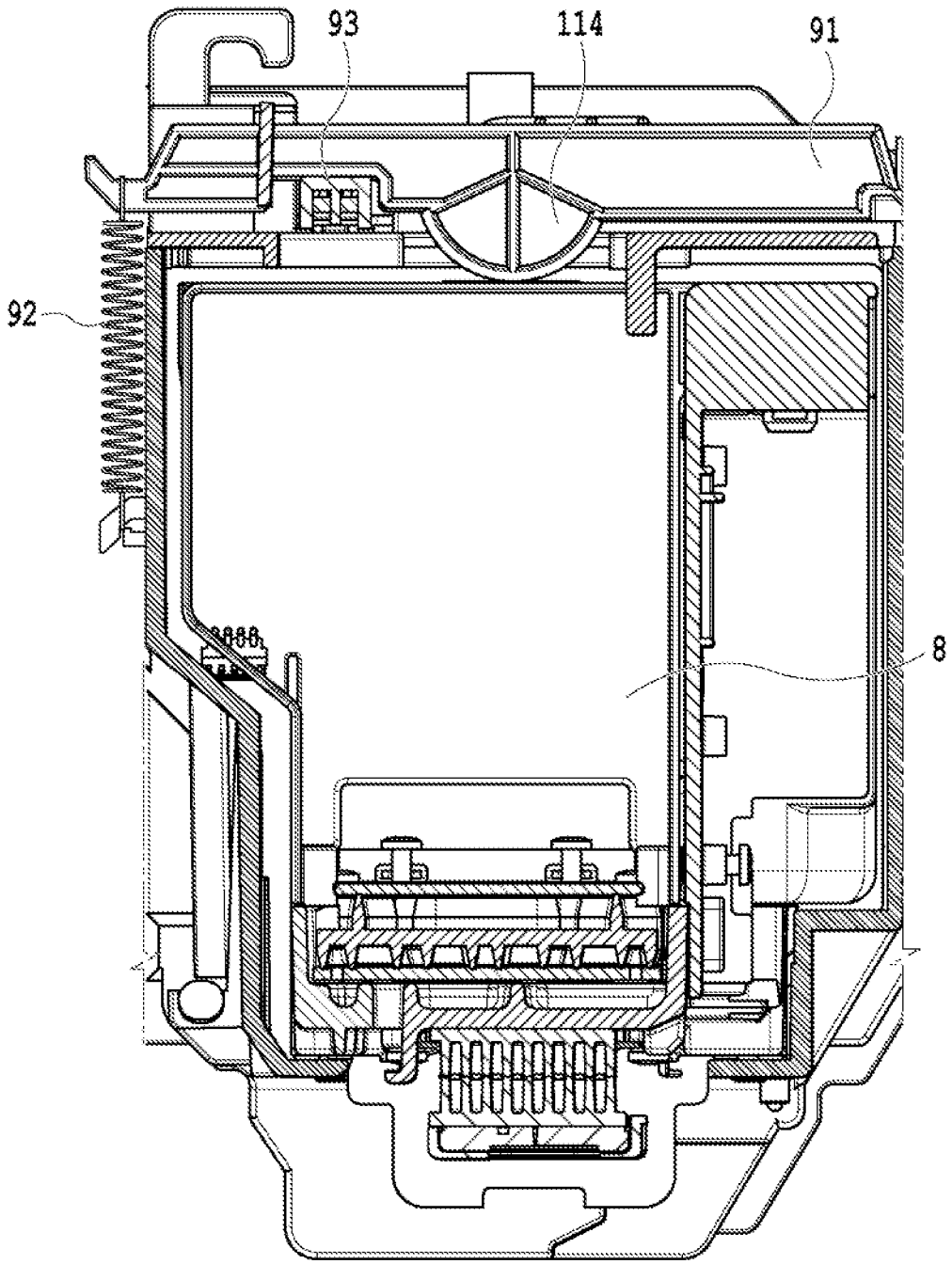
FIG. 10 illustrates a cross-sectional view showing the print head pressed by a head press member.

FIG. 10 is a cross-sectional view showing the print head 8 pressed by the head press member 91. The head press member 91 is equipped with a protruding unit 114 at an approximately central part in the longitudinal direction, and the protruding unit 114 presses the print head 8. Moreover, the head press member 91 is arranged so as to straddle the spacer member 93, and, in the state where the protruding unit 114 presses the print head 8 as the view, the head press member 91 and the spacer member 93 are spaced apart without contact. Accordingly, the head press member 91 presses the print head 8 by tension of the head press spring 92.

Figure 11:
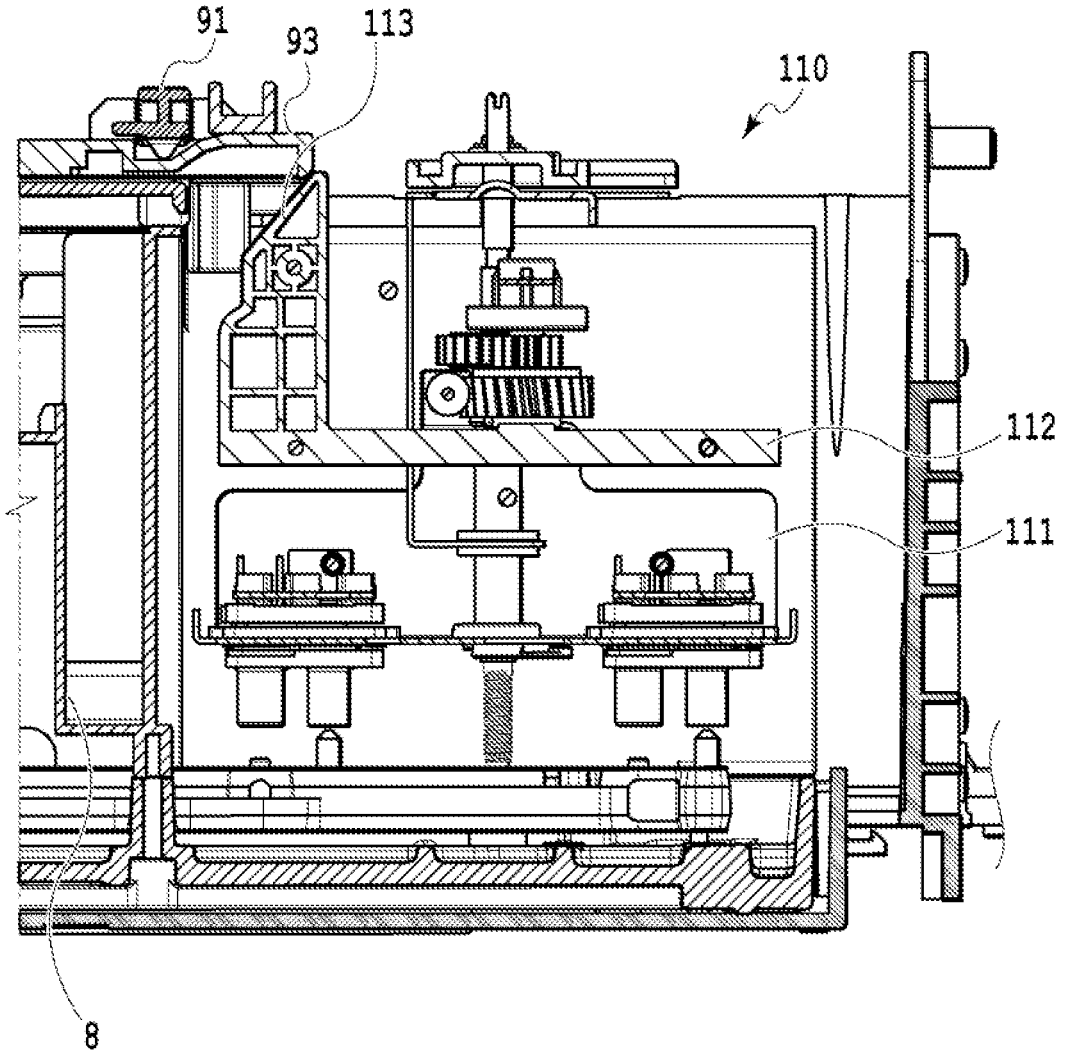
FIG. 11 illustrates a view showing the joint unit with which the print head and the joint member are connected.

FIG. 11 illustrates a view showing the joint unit 110 through which the print head 8 and the joint member 111 are connected, and shows a state where the connection between the print head 8 and the joint member 111 has been released. In this state, the connection between the print head 8 and the joint member 111 is released and the inclined unit 113 of the operation member 112 abuts on the spacer member 93. However, the spacer member 93 is not pressed from the inclined unit 113 and is not slid. Thus, the head press member 91 is still spaced apart from the spacer member 93, and therefore the print head 8 is in a state pressed with the head press member 91.

As described above, in this embodiment, it is configured such that, even when the connection between the print head 8 and the joint member 111 has been released, the pressure on the print head 8 from the head press member 91 is not released unless the joint member 111 furthermore rises to a predetermined height. In other words, although the connection between the print head 8 and the joint member 111 has been released, the print head 8 cannot be pulled out from the printing apparatus 1 as a consequence of pressure from the head press member 91.

In this embodiment, as described above, such a configuration is adopted that release of connection between the print head 8 and the joint member 111 and release of pressure between the print head 8 and the head holder 90 are performed separately. As a consequence, breakage of the printing apparatus 1 and contamination in the printing apparatus 1 by ink having leaked from a connection port, due to pullout of the print head 8 by a user prior to the release of connection of the print head 8 and the joint member 111, are prevented.

Figure 12:
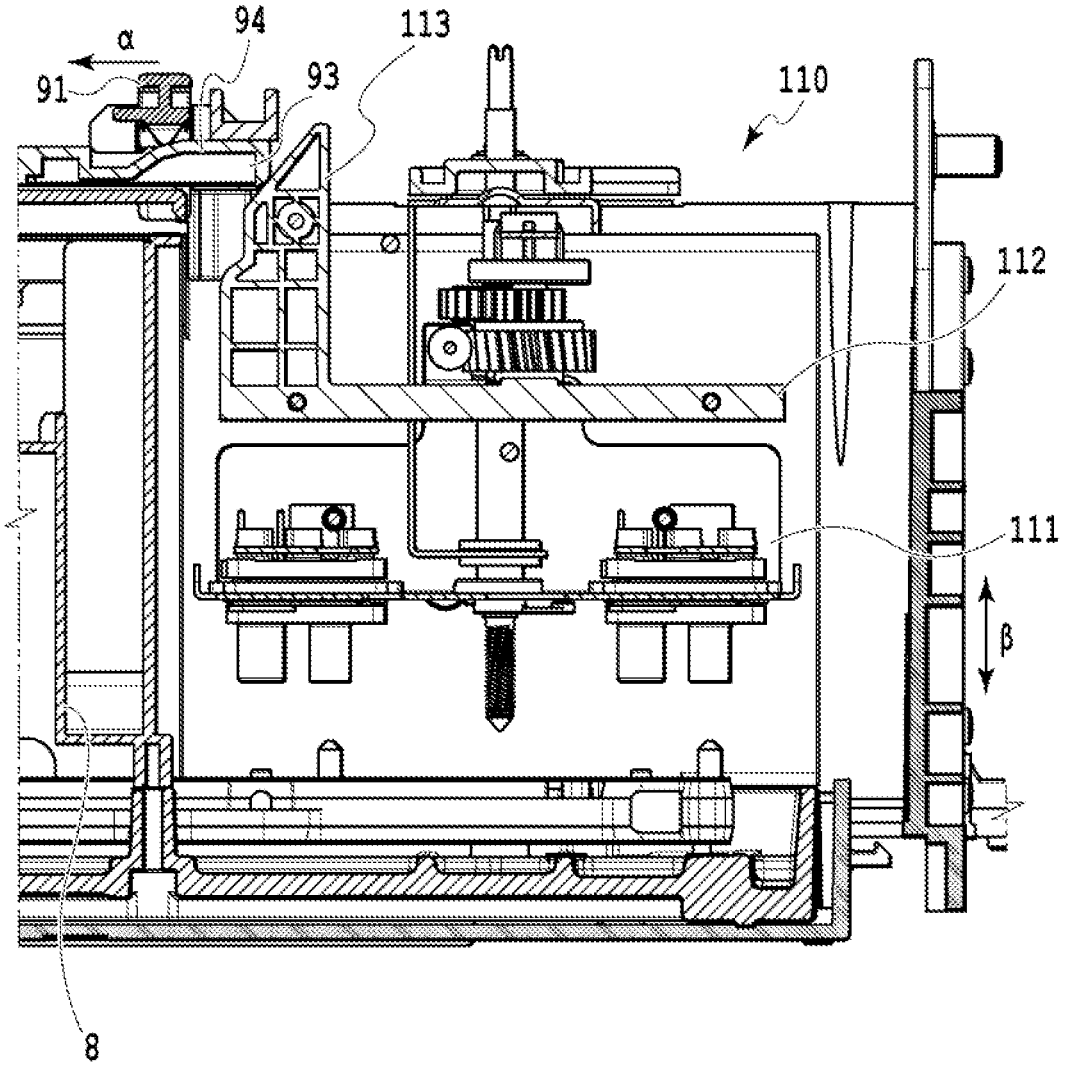
FIG. 12 illustrates a view showing the joint unit with which the print head and the joint member are connected.

FIG. 12 illustrates a view showing the joint unit 110 through which the print head 8 and the joint member 111 are connected, and shows a state where the connection between the joint member 111 and print head 8 has been released and the joint member 111 has been retracted from the print head 8. In other words, a state where the joint member 111 has risen to a prescribed position is shown. In this state, the spacer member 93 is pushed in the arrow α direction by the inclined unit 113 of the operation member 112 and has slid. As a consequence of a fact that the spacer member 93 is pushed by the inclined unit 113 and has slid in the arrow α direction, the head press member 91 is in a state of running on the cam unit 94, and pressure on the print head 8 from the head press member 91 has been released. In other word, in this state the print head 8 can be pulled out from the printing apparatus 1.

Figure 13:
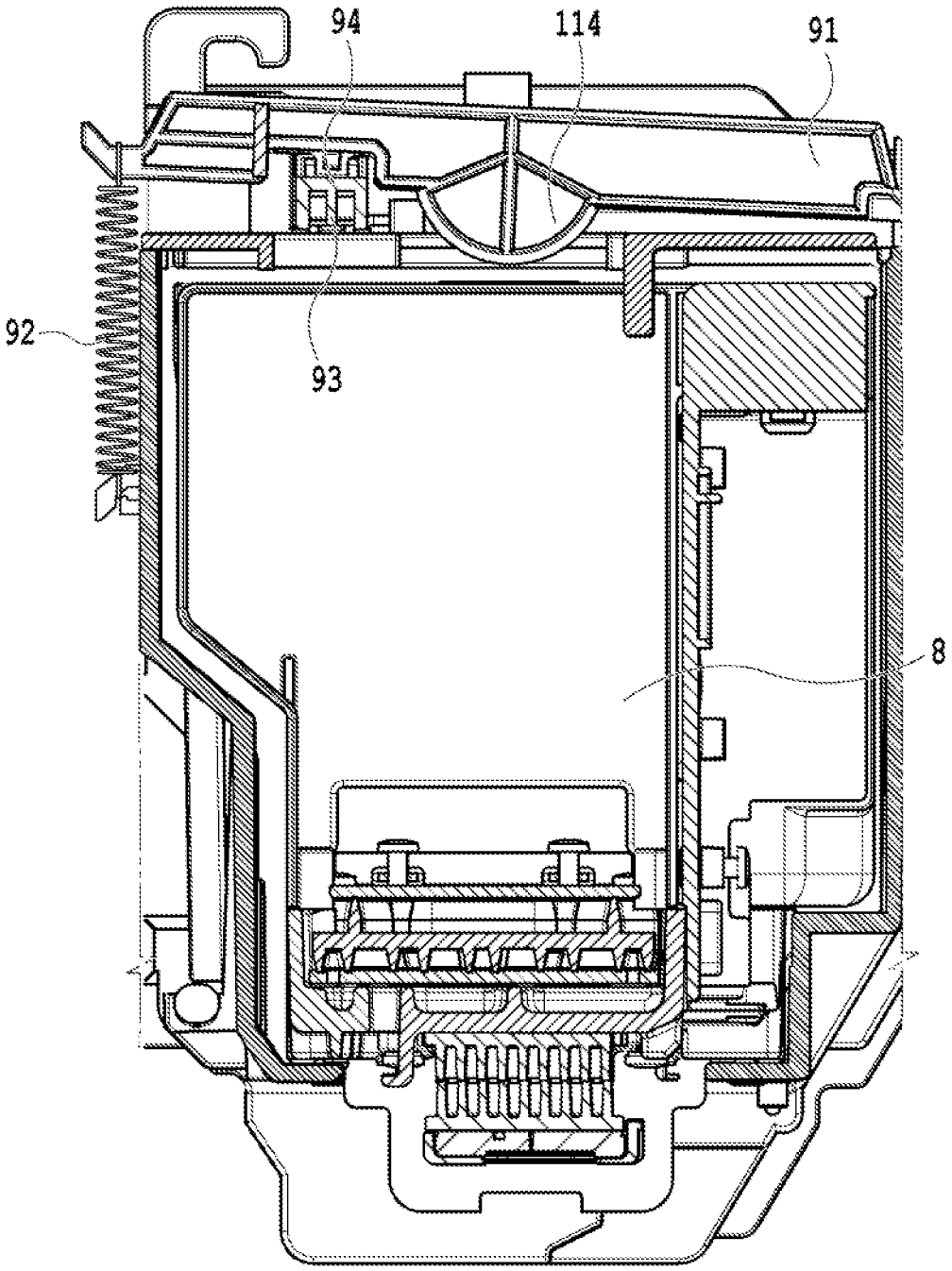
FIG. 13 illustrates a cross-sectional view showing the print head pressed with a head press member.

FIG. 13 illustrates a cross-sectional view showing the head press member 91 and the print head 8 corresponding to FIG. 12. The head press member 91 runs on the cam unit 94 of the spacer member 93 having slid in the arrow α direction, and thus turns against the tension of the head press spring 92 to thereby release the pressure on the print head 8.

Hereinbefore, steps when the connection between the print head 8 and the joint member 111 is released is explained, however, inversely when the print head 8 is connected with the joint member 111, above-described respective steps are performed inversely. Meanwhile, the print head 8 is not limited to that of a full line type but may be that of a serial type, which is configured to print an image by reciprocating scan in the width direction of a print medium.

In other words, in a case where the print head 8 is inserted into the head holder 90 from a state before the insertion of the print head 8, the joint member 111 starts to move for the connection with the print head 8. Accompanying to this, the operation member 112 also moves. As a consequence of the movement of the operation member 112, the spacer member 93 having been pressed by the inclined part 113 of the operation member 112 starts to move (slide). As a consequence of the movement of the spacer member 93, the print head 8 is pressed by the head press member 91. In this state, the connection between the print head 8 and the joint member 111 is not performed yet. After that, furthermore the joint member 111 moves to perform the connection between the print head 8 and the joint member 111.

Figure 14A:
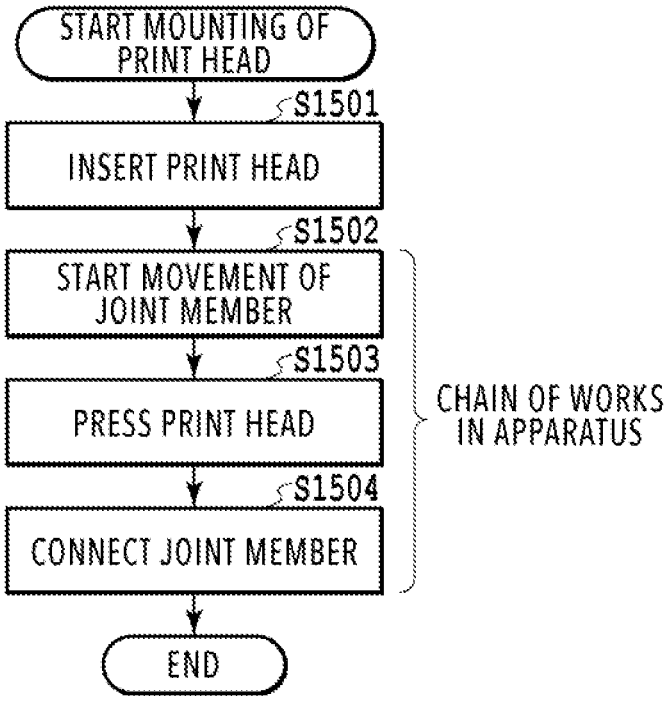
FIG. 14A illustrates a flow chart showing processing in mounting and demounting of the print head.
Figure 14B:
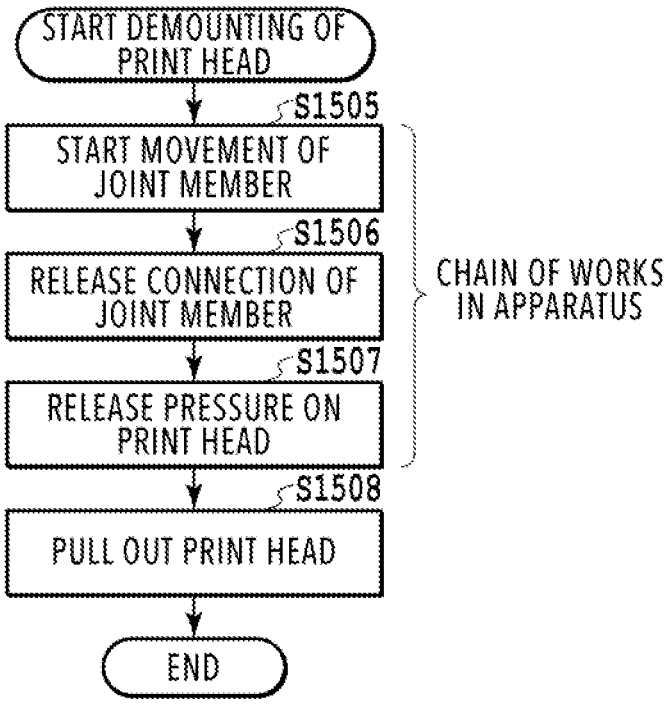
FIG. 14B illustrates a flow chart showing processing in mounting and demounting of the print head.

FIGS. 14A and 14B illustrate flow charts showing processing in mounting and demounting of the print head 8. In FIG. 14A, when mounting processing of the print head 8 is started, in S1501 the print head 8 is inserted into the printing apparatus 1 by a user. Then, in S1502 the joint member 111 starts movement (descent) for the connection with the print head 8, and in S1503 the print head 8 is pressed by the head press member 91 while the spacer member 93 slides. After that, in S1504 the connection between the print head 8 and the joint member 111 is performed. Each process from S1502 to S1504 is performed as a chain of works in the printing apparatus 1.

In FIG. 14B, when demounting processing of the print head 8 is started, and in S1505 when the joint member 111 starts movement (ascent) for releasing connection with the print head 8, in S1506 the connection between the print head 8 and the joint member 111 is released. Then, in S1507 the spacer member 93 releases pressure on the print head 8 while sliding. After that, the print head 8 is pulled out from the printing apparatus 1 by a user. Processes from S1505 to S1507 are performed as a chain of works in the printing apparatus 1.

In this way, it is configured so that the press or release for the print head 8 is possible along with the movement of the joint member 111. Further, when the joint member 111 is connected, the connection of the joint member 111 is performed after pressing the print head 8, and when the connection of the joint member 111 is released, the pressure on the print head 8 is released after releasing the connection of the joint member 111. As the result, it is possible to realize an inkjet printing apparatus capable of attaching and detaching of a print head with a mechanism that is easily operable and simple, while preventing an erroneous operation such as that the print head 8 is pulled out during connecting between the print head 8 and the joint member 111.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-068362 filed Mar. 30, 2018, which is hereby incorporated by reference herein in its entirety.

What is claimed is:

1. An inkjet printing apparatus comprising:
a support unit configured to detachably support a print head configured to eject ink;
a tank configured to store ink to be supplied to the print head;
a driving source;
a joint unit that is (1) connectable with the print head for supplying the ink from the tank to the print head and (2) movable by the driving source;
a pressing unit configured to press the print head against the support unit; and
a release unit configured to release pressure of the pressing unit in accordance with movement of the joint unit,
wherein the joint unit is movable to (1) a first position where the joint unit is connected with the print head and the print head is pressed against the support unit, (2) a second position where the joint unit is not connected with the print head and the print head is pressed against the support unit, and (3) a third position where the joint unit is not connected with the print head and the print head is not pressed against the support unit, and
wherein the release unit is configured to release pressure of the pressing unit by performing sliding movement between the pressing unit and the print head.

2. The inkjet printing apparatus according to claim 1, wherein the release unit releases pressure of the pressing unit in accordance with the movement of the joint unit from the second position to the third position.

3. The inkjet printing apparatus according to claim 2, wherein the joint unit comprises an inclined portion abuttable on the release unit, and
wherein the release unit releases pressure of the pressing unit by (a) abutting on the inclined portion in accordance with movement of the joint unit from the second position to the third position and (b) performing sliding movement between the pressing unit and the print head.

4. The inkjet printing apparatus according to claim 3, wherein the release unit includes a cam unit configured to receive pressure of the pressing unit when performing the sliding movement.

5. The inkjet printing apparatus according to claim 1, wherein one end part of the pressing unit is supported pivotally relative to the support unit, and presses the print head along with a rotation of the pressing unit.

6. The inkjet printing apparatus according to claim 1, wherein the pressing unit includes a protruding unit that presses the print head.

7. The inkjet printing apparatus according to claim 1, wherein the pressing unit is engaged with a spring, and presses the print head by tension of the spring.

8. The inkjet printing apparatus according to claim 1, wherein the print head is a line head in which a plurality of ejection ports configured to eject ink are arrayed in a region corresponding to the width of a print medium.

9. The inkjet printing apparatus according to claim 1, wherein the joint unit moves upward from the first position to the third position.

10. An inkjet printing apparatus comprising:
a support unit configured to detachably support a print head configured to eject ink;
a tank configured to store ink to be supplied to the print head;
a joint unit connectable with the print head for supplying the ink from the tank to the print head, the joint unit being movable by a driving source;
a pressing unit configured to press the print head against the support unit; and
a release unit configured to release pressure of the pressing unit by abutting on the joint unit moved by the driving source.

11. The inkjet printing apparatus according to claim 10, wherein the release unit releases pressure of the pressing unit by abutting on the joint unit moving upward.

12. The inkjet printing apparatus according to claim 10, wherein the release unit releases pressure of the pressing unit by performing sliding movement between the pressing unit and the print head.

13. The inkjet printing apparatus according to claim 12, wherein the joint unit comprises an inclined portion abuttable on the release unit.

14. The inkjet printing apparatus according to claim 12, wherein the release unit includes a cam unit configured to receive pressure of the pressing unit when performing the sliding movement.

15. The inkjet printing apparatus according to claim 10, wherein the pressing unit includes a protruding unit that presses the print head.

16. The inkjet printing apparatus according to claim 10, wherein the pressing unit is engaged with a spring and presses the print head by tension of the spring.

17. The inkjet printing apparatus according to claim 10, wherein the print head is a line head in which a plurality of ejection ports configured to eject ink are arrayed in a region corresponding to the width of a print medium.

* * * * *